United States Patent [19]

Taylor

[11] 4,267,549

[45] May 12, 1981

[54] PULL STATION PROTECTOR

[76] Inventor: John D. Taylor, 3951 Lotus Dr., Waterford, Mich. 48095

[21] Appl. No.: 117,365

[22] Filed: Jan. 31, 1980

[51] Int. Cl.[3] ..... G08B 25/00

[52] U.S. Cl. ..... 340/302; 340/297; 340/299

[58] Field of Search ..... 340/297, 298, 299, 300, 340/301, 302, 303

[56] References Cited

U.S. PATENT DOCUMENTS

| | | | |
|---|---|---|---|
| 3,042,910 | 7/1962 | Shull | 340/280 |
| 3,340,522 | 9/1967 | Chick | 340/274 |
| 3,797,006 | 3/1974 | Reininger | 340/274 |
| 3,886,537 | 5/1975 | Mann | 340/304 |

*Primary Examiner*—Harold I. Pitts
*Attorney, Agent, or Firm*—Gifford, VanOphem, Sheridan and Sprinkle

[57] ABSTRACT

A fire alarm pull station protector is provided comprising a wall mounted framing member and a cover adapted to abuttingly engage the framing member. The cover is pivotally connected to the framing member by hinge means having a laterally displacement pivotal axis to permit the cover to remain disengaged from the framing member once the cover has been opened to gain access to the fire alarm pull station. The cover includes a first, preferably opaque, portion which conceals a local alarm and switch unit, as well as a substantially transparent portion which provides a substantially unobstructed view of the pull station.

7 Claims, 3 Drawing Figures

PULL STATION PROTECTOR

BACKGROUND OF THE INVENTION

I. Field of the Invention

The present invention relates generally to intrusion alarms operable upon the opening or closing of a door, window or the like, and more particularly, such a device adapted to cover a pull station for a fire alarm in order to provide a local alarm which indicates that the particular pull station has been activated or tampered with.

II. Description of the Prior Art

Fire alarm pull stations are well known and as often required by laws and municipal ordinances, are secured to the walls of corridors and hallways in many locations throughout buildings. These pull stations must be made highly visible and readily accessible so that they provide a timely means for sounding an emergency signal when a fire has been spotted. Nevertheless, the need for great visibility and accessibility also makes these pull stations vulnerable to abuse by vandals, pranksters, etc. This problem is especially apparent in school buildings where the large number of students in crowded hallways make it difficult to detect who has pulled the alarm or even which alarm has been pulled when a false alarm signal has been sounded.

A previously-known device for detering vandalism of the pull stations and the sounding of false alarms is disclosed in U.S. Pat. No. 3,886,537 to Mann et al. and comprises an alarm in which the fire alarm call box is contained. The booth is provided with local alarm signals so that when a fire alarm signal is sounded, the local signal indicates which call box was activated. In addition, the alarm call box is made operable only when the door to the booth is closed, and once the door is closed it remains locked for a predetermined period of time unless the lock mechanism has been deactuated by fire or authorized personnel. Such a device is disadvantageous since it is quite large and costly to build. Moreover, since the booth must be occupied and the door closed before the fire alarm can be activated, it does not provide access to the fire alarm for individuals confined to a wheel chair or those unable to read the exacting directions necessary to operate the fire alarm call box mounted in the booth.

SUMMARY OF THE PRESENT INVENTION

The present invention overcomes the above-mentioned disadvantages by providing a protective cover for a wall mounted station protector, wherein the cover includes a local or location indicating audible signal when access to the pull station is attained. The protector generally comprises a framing number having a compartmented cover hinged thereto and abuttingly engaging substantially the entire periphery of the framing member. The cover has a handle which is pulled so that the cover is pivoted about a preferably displaceable hinge axis to expose the pull station enclosed behind the protective cover. Upon pivoting movement of the protective cover with respect to the frame, a switch mechanism is actuated to sound a local alarm contained within a portion of the protective cover.

A portion of the cover containing the alarm and the power source for the alarm is separated from the part of the cover which encloses the pull station by a plate which prevents disconnection of the local alarm circuit before the pull station is actuated. Nevertheless, the plate is removable from the protector in order to permit replacement of the power supply for the alarm. The switch is disposed adjacent to the alarm unit chamber of the protector so that it remains inaccessible for deactivation when the pull station is to be actuated.

The framing member flatly abuts against the wall while the open end of the compartmentalized cover substantially entirely abuts against the framing member so as to totally enclose the pull station within a portion of the cover.

Engagement means normally securely supports the cover in its closely abutting position with respect to the frame. Nevertheless, the engagement means is relatively easily overcome by pulling the handle to pivot the cover with respect to the frame. Such pivoting causes actuation of the localized alarm signal which provides an indication identifying which pull station is about to be or has been activated, thus providing a way to detect and thus apprehend a vandal or prankster unnecessarily tampering with the pull station.

Preferably, as shown in the preferred embodiment of the present invention, the hinge means can be laterally extended so that once the cover has been pivoted to its open position, the cover is displaced from the frame and requires realignment with respect to the frame. Such a construction is advantageous since it avoids deactivation of the local alarm until the protective cover is realigned and abuttingly engaged with the framing member.

BRIEF DESCRIPTION OF THE DRAWING

The present invention will be better understood by reference to the following detailed description in conjunction with accompanying drawing in which like reference characters refer to like parts throughout the several views and in which.

DETAILED DESCRIPTION OF A PREFERRED EMBODIMENT OF THE PRESENT INVENTION

Figure 1:
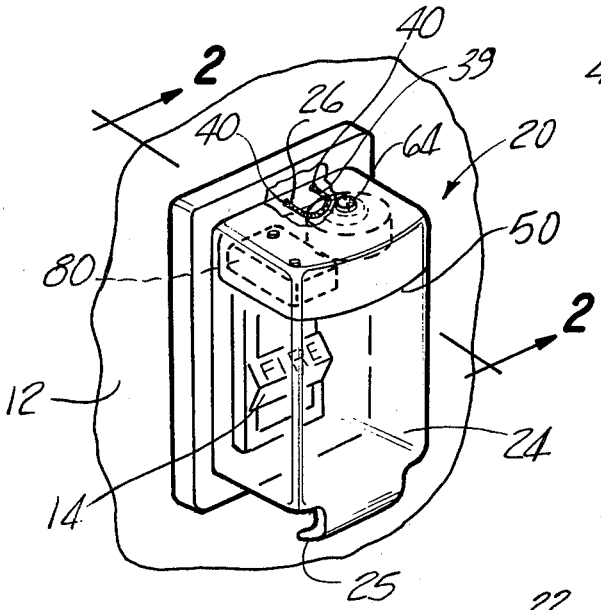
FIG. 1 is a perspective view of a pull station protector of the present invention.

Referring now to FIG. 1, the pull station protector 20 of the present invention is thereshown secured to a wall 12 around the wall mounted pull station 14. Although the pull station is commonly a lever type alarm actuator, the particular type of pull station 14 is not an important feature of the present invention. Rather, it is only necessary that the pull station 14 be secured to a wall 12 as shown in FIG. 1.

Figure 3:
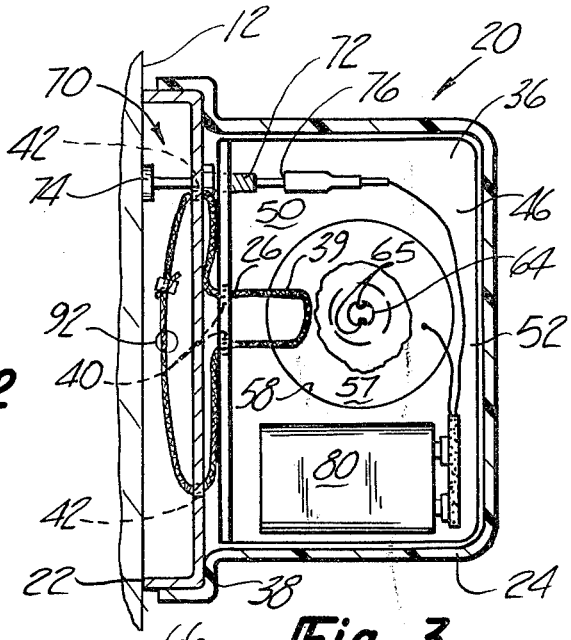
FIG. 3 is a sectional view taken substantially along line 3—3 in FIG. 2.
Figure 2:
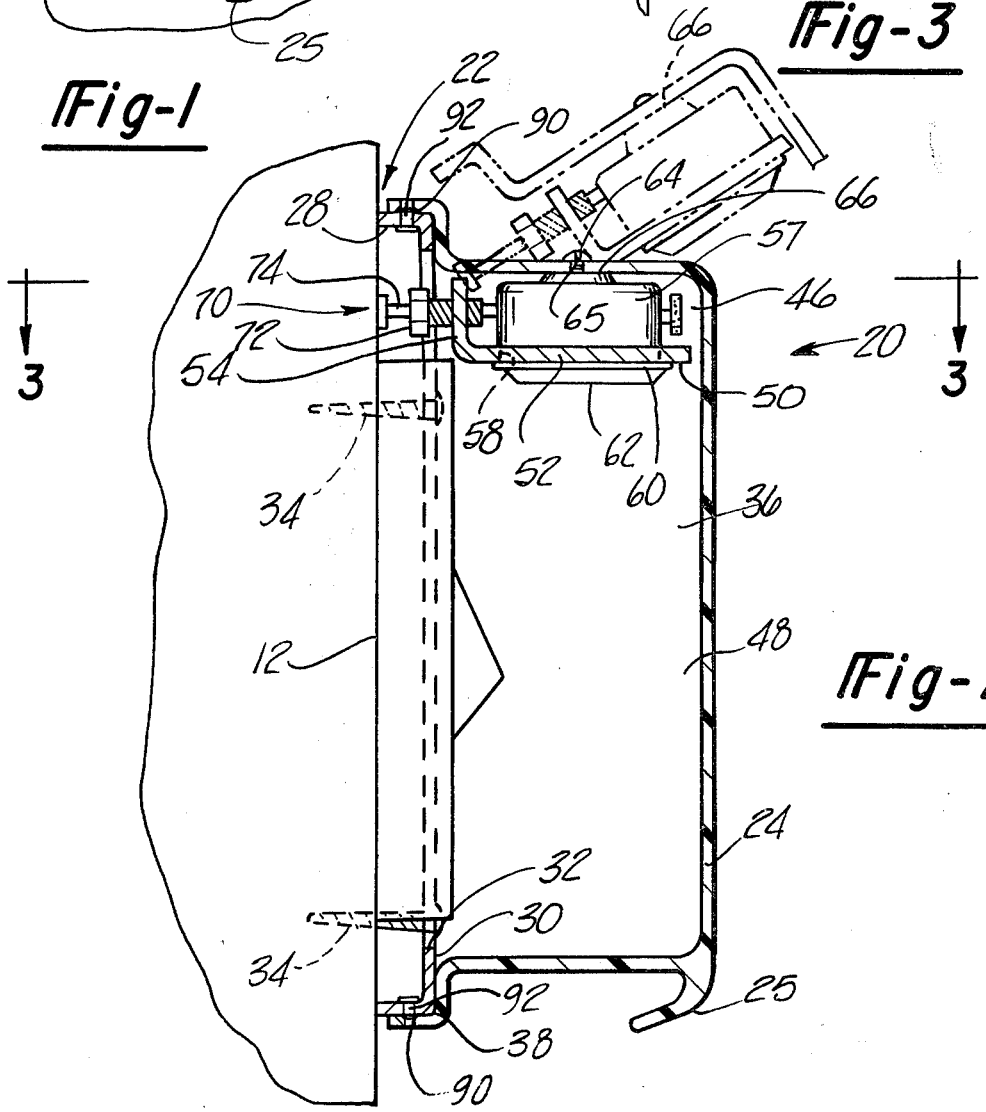
FIG. 2 is a sectional view of the pull station protector of the present invention taken substantially along line 2—2 in FIG. 1.

As best shown in FIGS. 2 and 3, the protector 20 of the preferred embodiment of the present invention comprises a framing member 22 having a cover 24 pivotally secured thereto by hinge means 26. The frame member 22 includes a peripheral side wall 28 and a front wall 30 having an enlarged central opening 32. Framing member 22 is secured to the wall 12 by screws 34 or the like so that the walls 28 and 30 surround the pull station 14 and the pull station 14 is exposed through the opening 32 in the framing member 22.

The cover 24 defines an open-ended chamber 36. The cover 24 includes flanged extension 38 adjacent the open end of the chamber 36. The flanged extension 38 is appropriately dimensioned to engage the walls 28 and 30 of the framing member 22. Thus the chamber 36 becomes substantially enclosed when the extended flange 38 of the cover 24 abuttingly engages framing member 22. Preferably, the top of the cover 24 is pivotally secured to the top of the framing member 22 by the hinge means 26.

As shown in the drawing illustrating the preferred embodiment, the hinge means 26 comprises a cord 39 of intertwined metal strands wrapped around a solid flexible wire. The cord 39 is interwoven through appropriate apertures 42 and 40 in the frame member 22 and a plate 50 secured to the cover 24, respectively. A side wall 54 of the plate 50 is provided with apertures 40 and the framing member 22 is provided with a pair of apertures 42 at opposite sides of the front wall 30. The cord 39 is interwoven through the holes 42 and 40 so that the top of the cover 24 is secured to the upper portion of the framing member 22. The strand 39 is provided with enlarged anchor caps 44 which prevent the strand 39 from being pulled back through the apertures 42. However, the length of the strand 39 is slightly longer than is necessary to tightly hold the top of the cover 24 against the top of the framing member 22 for a reason to be described hereinafter.

The chamber 36 of the cover 24 is divided into a first alarm chamber portion 46 and a second pull station chamber portion 48 by the mounting plate 50 secured to the cover 24 in the upper part of the chamber 36. As best shown in FIG. 2, the plate 50 includes a first support wall 52 and a second side wall 54. The support wall 52 includes a large aperture adapted to receive the housing 58 of the alarm unit 57. The housing 58 is shown in FIG. 2 as having a radially extending flange 60 which abuts against the lower surface of the plate wall 52 so that the speaker portion 62 of the alarm 57 communicates with the chamber portion 48 in the cover 24. A screw 64 extending through an aperture on the top of the cover 24 threadably engages the upper wall 66 of the housing 58 to secure the alarm unit within the upper chamber 46 and thereby secure the plate 50 to the cover 24. Preferably, the screw 64 includes an enlarged head portion having unconventional screw engagement means such as the slots 65, so that a special tool is required to remove or loosen the alarm 57 as well as the plate 50.

A plunger type switch 70 is secured to the side wall 54 of the mounting plate 50. The switch 70 comprises a switch housing 72 secured within an aperture in the side wall 54. One end of a plunger 74 extends outwardly from the housing 72 towards the wall 12 and is resiliently biased to extend outwardly toward the wall 12 by resilient means (not shown) contained within the housing 70. The other end of the plunger 74 extends outwardly from the other end of the housing 72 and includes an electrical contact 76 which is separated from the housing 72 when the one end of plunger 74 is displaced inwardly toward the housing 72 against the force of the resilient means and abuts against the wall 12. Likewise, when the plunger 74 is fully extended by the resilient means in the housing 72, the electrical connector 76 contacts the housing 72 and closes an electrical connection therethrough. The contact 76 is appropriately connected to the alarm by electrical circuit means and a power source such as a battery 80 supported by the support plate 50 within the alarm unit chamber 46. Electrical circuit means connect the components in a series connection.

The cover 24 is preferably made of plastic and at least the portion covering the chamber portion 48 is substantially transparent so that the pull station 14 is visible therethrough. It is also preferable that the upper portion of the cover 24 defining the chamber 46 is opaque so that the construction of the switch means is not readily assertainable from the exterior of the protector 20. Nevertheless, since the chamber 46 is aside the pull station, visibility of the pull station is not obstructed. In addition, a handle 25 is secured to the lower end of the cover 24 so that the cover 24 can easily be pivoted with respect to the framing member 22 about the hinge means 26.

In addition, the uppermost and lowermost walls of the flange 38 contains a beveled aperture 90 which registers with a rivet 92 secured in the uppermost and lowermost side walls 28 of the framing member 22. The rivet 92 extends slightly outwardly from the outer periphery of the wall 28 so that it extends partially into the beveled aperture 90. However, due to the bevel in the aperture 90, the flange 38 can easily be slid passed the extending portion of the rivet 92 by pulling the handle 25 away from the wall 12.

Having thus described the important structural features of the preferred embodiment of the invention shown in the drawings, the operation of that embodiment can be easily understood. The framing member 22 is first secured to the wall 12 by screws 34 or the like so that the framing member 22 surrounds the pull station 14 mounted in the wall and the pull station 14 is exposed through the opening 32 in the framing member 22. Consequently, substantially the entire pull station is visible through the transparent portion of the cover 24 surrounding the chamber portion 48 when the cover 24 abuttingly engages the framing member 22. The cover is aligned in its frame engaging position and locked in position by the rivets 92. The free end of the plunger 72, thus, abuts against the wall 12 and is retracted within the housing 72 against the force of the resilient means within the housing. Thus, the contact member 76 is spaced apart from the housing 72, thereby open circuiting the alarm and power source circuit. However, when it is necessary to activate the pull station 14, the handle 25 at the lower end of the cover 24 is pulled outwardly from the wall, disengaging the rivet 92 from the aperture 90, permitting the cover 24 to pivot about the hinge means 26 to the position shown in phantom lines in FIG. 2. This pivoting of the cover 24 enables the resilient means within the housing 72 to urge the plunger to its fully extended position. When the plunger 74 is in its fully extended position, the contact member 76 abuts against the coupling 72, thereby closing the electrical circuit and causing actuation of the alarm 57.

Since the hinge means 26 of the preferred embodiment comprises a flexible hinge pin (cord 39) having a length substantially longer than is necessary to tightly abut the top of the cover 24 against the top of the framing member 22, the cover 24 can be laterally displaced from the framing member 22 when the retaining force of the frictional engagement means is overcome by pulling on the handle 25. The hinge means does not resist the pulling force and permits the cover 24 to be laterally displaced from the framing member 22. Since the hinge means does not resiliently urge the cover 24 into abutting engagement with the framing member 22, the cover 24 remains displaced from the framing member 22 until manually realigned. The plunger 74 therefore remains spaced apart from the wall in its fully extended position. Thus, the switch means 70 remains closed so that the alarm circuit remains continuously activated to provide a continuous localized signal indicating that the pull station 14 covered by the protector has been activated or tampered with. In addition, the lateral separation of the cover 24 from the framing member 22 permits greater dispersion of the audible signal produced by the alarm 57 since the chamber 36 is no longer substantially sealed.

Thus, the present invention provides a fire alarm pull station protector which does not interfere with the visibility of or the accessibility to the pull station. The pull station is easily viewed through the substantially transparent portion of the cover 24 surrounding the chamber 48 and frictional engagement means provides for relatively simple access to the pull station protector. Nevertheless, the pull station protector provides a local signal to indicate that an attempt has been made to gain access to the pull station protector by emitting a continuous signal once the cover has been opened by overcoming the frictional engagement means.

Moreover, as the preferred embodiment is illustrated in the drawing, the support plate 50 in conjunction with the opaque portion of the cover 24 provides protection against tampering with the alarm circuit by an intruder in an attempt to deactivate the continuously sounding local alarm. Consequently, the pull station protector of the present invention effectively deters the vandalizing of pull stations and the setting of false alarms by providing an advance and continuous indication that the pull station is being tampered with.

Having thus described my invention, many modifications thereto will become apparent to those skilled in the art to which it pertains without departing from the scope and spirit of the invention as defined in the appended claims. For example, it is conveived that the alarm unit can be modified to also include means for sending a remote signal to a main station, whereby the condition of each pull station protector throughout the building can be monitored. Thus, the proper authorities can be immediately provided an indication of the location at which an emergency situation or an attempt to tamper with the fire alarm pull stations has occurred.

What is claimed is:

1. A protector for enclosing wall mounted fire alarm pull stations comprising:

a centrally open mounting frame secured against the wall and surrounding the pull station mounted in the flat wall;

a cover defining an open ended chamber wherein the side of the cover adjacent the open end is dimensioned to abuttingly engage substantially the entire periphery of said mounting frame;

a hinge means for pivotally securing said cover to said mounting frame, said cover being pivotable between and a first position in which said cover abuttingly engages substantially the entire periphery of said mounting frame such that the pull station is enclosed behind said cover, and a second position in which said pull station is uncovered;

engagement means for holding said cover in said first position;

a support plate secured to said cover and dividing said chamber into first and second chamber portions, said first chamber portion being disposed aside the pull station when said cover is in said first pivotal position;

an alarm and an electrical power source for said alarm secured in said first chamber portion; and means for activating said alarm when said cover is moved from said first pivotal position toward said second pivotal position, said activating means being disposed adjacent said first chamber portion, and wherein said cover includes a substantially transparent portion covering said second chamber portion and a handle, and further wherein said hinge means is secured to said cover adjacent said first chamber portion.

2. The invention as defined in claim 1 wherein said activating means comprises a normally closed switch having a spring biased plunger, said plunger being displaced by abutment with the wall so that said switch is open when said cover is in said first position.

3. The invention as defined in claim 3 wherein said switch is secured to said support plate.

4. The invention as defined in claim 1 wherein said support plate is secured to said cover by a threaded fastener having an enlarged head exposed externally of said cover, said head being provided with a pair of diametrically opposed notches.

5. The invention as defined in claim 1 wherein said frame member includes a peripheral side wall and a front wall and said cover includes a flange adapted to abuttingly engage substantially the entire said front wall.

6. The invention as defined in claim 1 wherein said hinge means includes a laterally displaceable hinge axis whereby said cover is laterally displaceable from said hinge member.

7. A fire alarm pull station protector for wall mounted fire alarm pull stations comprising;

a frame member having a central opening, mounted to a wall so as to surround the pull station;

a cover defining an open ended chamber wherein the side of the cover adjacent the open end is dimensioned to abuttingly engage substantially the entire periphery of the mounting frame, hinge means having a laterally displaceable pivotal axis for pivotally securing said cover to said frame member, said cover being pivotable between a first position in which said cover abuttingly engages said mounting frame, such that the pull station is enclosed behind said cover, and a second position in which said pull station is uncovered, frictional engagement means for holding said cover in said first position, alarm means for indicating when said cover is moved from said first position toward said second position, and a handle secured to said cover, whereby when a pulling force is exerted upon said handle sufficient to overcome the resistance of said frictional engagement means, said cover is displaced laterally away from said frame member as said cover is pivoted from said first to said second position.

* * * * *